US006431394B2

(12) United States Patent
Frankenberg

(10) Patent No.: US 6,431,394 B2
(45) **Date of Patent: *Aug. 13, 2002**

(54) PLASTIC TOTE BOX IMPROVEMENTS

(75) Inventor: Jason R. Frankenberg, Waukesha, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/965,342

(22) Filed: Sep. 27, 2001

Related U.S. Application Data

(63) Continuation of application No. 09/460,154, filed on Dec. 13, 1999.

(60) Provisional application No. 60/112,876, filed on Dec. 18, 1998.

(51) Int. Cl.[7] ..... B65D 51/04

(52) U.S. Cl. ..... 220/826; 220/843; 220/770; 220/771; 206/508

(58) Field of Search ..... 206/505, 508; 220/770, 771, 756, 826, 840, 843, 844, 380

(56) References Cited

U.S. PATENT DOCUMENTS

| | | | | |
|---|---|---|---|---|
| 2,773,624 A | * | 12/1956 | Knieriem et al. | 206/512 |
| 2,823,828 A | | 2/1958 | Frater | |
| 2,897,999 A | | 8/1959 | Bishop | |
| 2,986,300 A | | 5/1961 | Parrish | |
| 3,282,462 A | | 11/1966 | Box | |
| 3,331,529 A | | 7/1967 | Slapnik | |
| 3,379,341 A | | 4/1968 | Miles | |
| 3,419,184 A | * | 12/1968 | Asenbauer | 206/508 |
| 3,463,345 A | | 8/1969 | Bockenstette | |
| 3,987,829 A | * | 10/1976 | Leone | 220/675 |
| 4,000,817 A | | 1/1977 | Sanders et al. | |
| 4,161,261 A | | 7/1979 | Frater | |
| 4,189,052 A | | 2/1980 | Carroll et al. | |
| 4,372,444 A | | 2/1983 | Le Grand et al. | |
| 4,432,467 A | | 2/1984 | Swingley, Jr. | |
| 4,498,860 A | | 2/1985 | Gahan | |
| 4,520,928 A | | 6/1985 | Wilson | |
| 4,523,681 A | | 6/1985 | Kreeger | |
| 4,685,567 A | | 8/1987 | Webb | |
| 4,688,675 A | | 8/1987 | Miller et al. | |
| 4,740,150 A | | 4/1988 | Sayer | |
| 4,782,972 A | | 11/1988 | Wenkman et al. | |
| 4,892,221 A | | 1/1990 | Gora et al. | |
| 4,923,666 A | | 5/1990 | Yamazaki et al. | |
| 4,982,844 A | | 1/1991 | Madan et al. | |
| 5,035,326 A | | 7/1991 | Stahl | |
| 5,328,048 A | | 7/1994 | Stein | |
| 5,353,948 A | | 10/1994 | Lanoue et al. | |
| 5,582,296 A | | 12/1996 | Beauchamp et al. | |
| 5,770,237 A | | 6/1998 | Sayer et al. | |
| 5,860,527 A | | 1/1999 | Frankenberg et al. | |
| 6,318,586 B1 | * | 11/2001 | Frankenberg | 206/508 |

FOREIGN PATENT DOCUMENTS

| | | |
|---|---|---|
| WO | WO 89/06208 | 7/1989 |

* cited by examiner

*Primary Examiner*—Lee Young
*Assistant Examiner*—Robin A Hylton
(74) *Attorney, Agent, or Firm*—Quarles & Brady LLP

(57) ABSTRACT

A plastic tote box of the type having a lid. The lid is a two-piece hinged lid, with each piece of the lid being hinged along the top of opposite sides of the box. Each of the lid pieces has at least one hollow channel formed therein. The hollow channels improve the structural integrity of the lid pieces without adding additional lid material. In a box top lid having a substantially planar central area surrounded by a raised peripheral edge, a cut out is formed in the peripheral edge providing a drainage path for fluid which has collected in the central area to flow off the lid without entering the box. A mail slot is formed in a box side for insertion of a packing slip or the like into the box without opening the box lid.

10 Claims, 4 Drawing Sheets

PLASTIC TOTE BOX IMPROVEMENTS

CROSS-REFERENCE TO RELATED APPLICATIONS

This application claims the benefit of U.S. Provisional Patent Application No. 60/112,876 filed Dec. 18, 1998, and is a continuation of U.S. patent application Ser. No. 09/460,154 filed on Dec. 13, 1999.

STATEMENT REGARDING FEDERALLY SPONSORED RESEARCH OR DEVELOPMENT

Not Applicable.

FIELD OF THE INVENTION

This invention relates to improvements in plastic tote boxes, and in particular to a tote box having improved structural integrity, drainage, and security.

BACKGROUND OF THE INVENTION

Plastic tote boxes have been known for a number of years and have found widespread usage in commercial and residential applications. Such boxes have been available having no lids, with one-piece lids which enclose the entire top of the box, or with two-piece lids, each piece of which is hinged along one side of the tote box and in which the pieces meet along a line of closure generally in the middle of the box top. These boxes are used for storing and transporting parts or other items and are reusable. The boxes and their lids are also typically made of plastic materials which are recyclable.

Plastic tote boxes having two piece lids are particularly troublesome when a heavy object is placed on the lid. The heavy object may cause the box sides to flex outward, separating the two piece lid and allowing the object to fall into the box. The two piece lid then snaps back into place with the object inside the box and no indication of its location. If the object is taller than the box, the object falls to the box bottom and is trapped by the box lid pieces impinging on the object sides, making removal of the object from the box difficult.

During shipment and storage, boxes of the type described, individually and in stacks, are also subjected to moisture, such as rain, condensation, accidental or intentional spraying, or leakage from an upper box to a lower box. If this moisture is permitted to enter the box, it can sometimes damage or ruin the items contained in the box. It is, therefore, desirable that moisture collected on the box lid be directed away from the interior of the box.

Tote boxes of the type described are also often secured by strapping a band around the box exterior to keep the box sides from flexing outward and the lid from inadvertently opening. The band tends to dig into the box edges causing then to crack and fail. If the box is strapped over lid hinges, the hinges can be crushed by the tightened strap rendering the hinge inoperable.

Furthermore, packing slips are often required in a box for shipment. The packing slip is often available only after the box has been closed and stacked. This makes insertion of the slip into the box very difficult. Currently, in order to insert a packing slip in a closed stacked box, the box stack must be disassembled to the desired box and the box must be opened to insert the slip into the box.

SUMMARY OF THE INVENTION

The invention provides improvements in a plastic tote box of the type having a two-piece hinged lid, with each piece of the lid being hinged along the top of opposite sides of the box. In a box incorporating the invention, each of the lid pieces has at least one channel which is closed for 360° in a plane perpendicular to a longitudinal axis of the channel and formed in at least one of the lid sections to increase the strength of each lid section. The channel overlaps the other lid section when the lid is closed.

In another aspect of the invention, a hollow channel in each lid piece overlaps the other lid piece, further increasing the structural integrity of the closed lid.

In another aspect of the invention, a plastic tote box of the type which is provided with a lid having a substantially planar central area surrounded by a raised peripheral edge has a cut out formed in the peripheral edge, providing a planar surface extending through the peripheral edge. The planar surface provides a path for fluid which has collected in the central area to flow off the lid without entering the box.

In another aspect of the invention, a plastic tote box of the type which is provided with four generally vertical sides and a lid for covering an open top of the box has at least one of the box sides with a mail slot formed in it. The mail slot allows insertion of a packing slip or the like into the box without opening the box lid.

Other objects and advantages of the invention will be apparent from the drawings and detailed description.

DETAILED DESCRIPTION OF THE PREFERRED EMBODIMENTS

Figure 1:
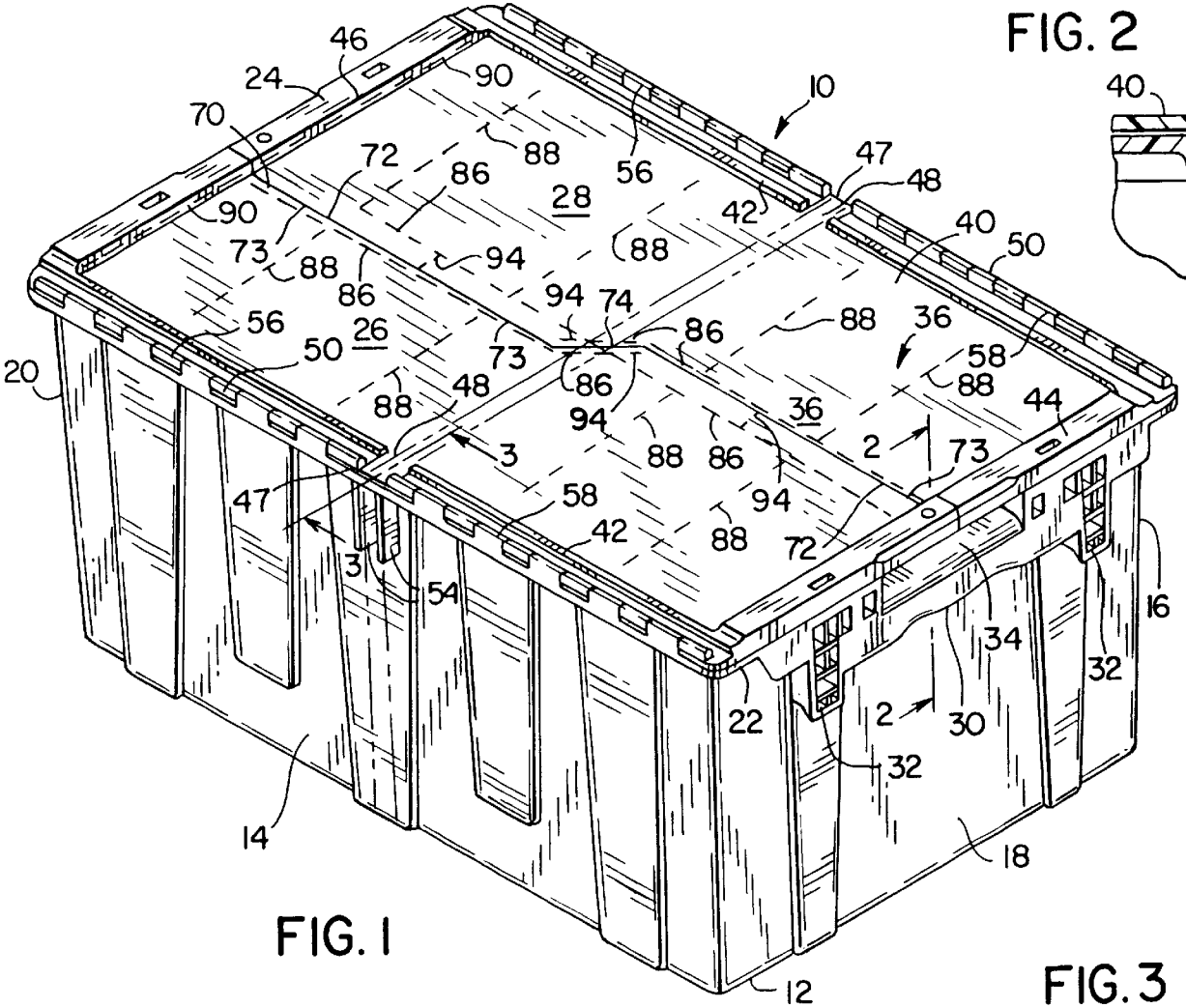
FIG. 1 is a perspective view of a tote box incorporating the invention.
Figures 4, 5, 6:
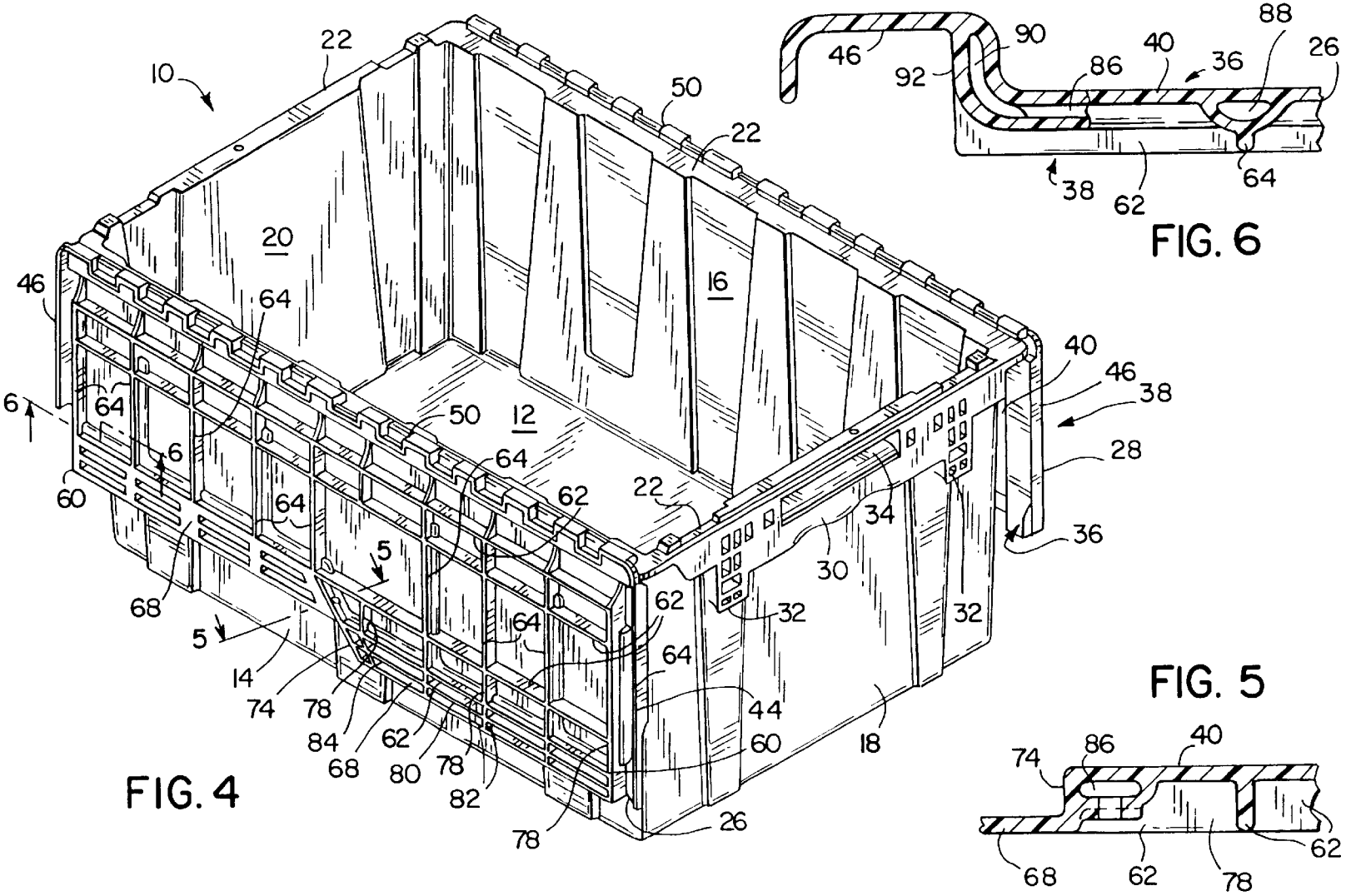
FIG. 4 is a perspective view of FIG. 1 with the lid open.
FIG. 5 is a cross sectional view of FIG. 4 along line 5—5.
FIG. 6 is a cross sectional view of FIG. 4 along line 6—6.

FIGS. 1 and 4 illustrate a tote box 10 of the present invention. The tote box 10 is molded plastic, for example polypropylene, and has a bottom 12, longitudinally extending sides 14, 16, and laterally extending end walls 18, 20. At the top of the side 14, 16 and end 18, 20 walls, a rim 22 encircles the top of the box 10. A lid 24 is formed from two pieces 26, 28 hinged along the top of adjacent respective sidewalls 14 or 16.

As is conventional, all of the walls 14, 16, 18, and 20 taper outwardly at a certain draft angle from the bottom 12 up so that one box 10 can be nested inside another box 10 with the lid open. Alternatively, the boxes 10 can be stacked by placing one box 10 on the closed lid 24 of another box 10.

Figure 2:
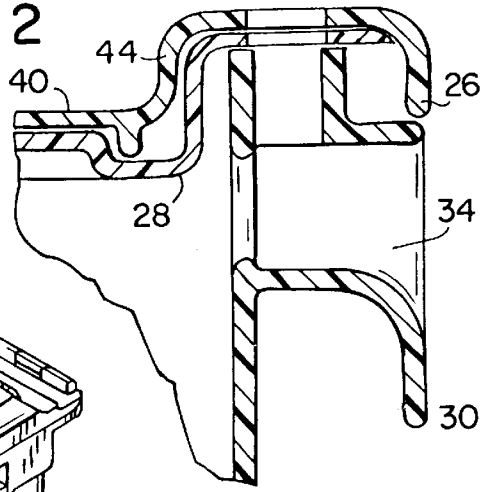
FIG. 2 is a cross sectional view of FIG. 1 along line 2—2.

It is also noted that at the midpoints of the end walls 18 and 20, a handle 30 which conforms arcuately to the fingers of a person carrying the box 10 using both hands on the ends 18, 20 is formed. The handles 30 are best shown in FIGS. 1, 2, and 4. Nesting stops 32 are provided on each side of each handle 30, which rest against the rim 22 of the lower box 10 when nesting the boxes 10.

Referring particularly to FIGS. 1 and 2, a mail slot 34 disposed above the handle 30 is formed in the end wall 18.

The mail slot 34 provides an opening into the box 10 for a packing slip or the like. Thus, the packing slip can be inserted into the box 10 without opening the box lid 24. This is particularly advantageous when the box lid 24 is locked or the box 10 is part of a box stack.

As shown in FIGS. 1 and 4, the lid 24 is formed from two identical pieces 26, 28 hinged along the top of the adjacent respective side wall 14 or 16, and has a top side 36 and an underside 38. The lid top side 36 is a substantially central planar surface 40 surrounded by a raised peripheral edge. The peripheral edge is formed as an integral part of the pieces 26 and is defined by raised longitudinal edges 42 along the top of each box sidewall 14, 16 joined by raised end lips 44 which wrap over the rim 22 above the box end walls 18, 20. The raised edges 42 and lips 44 prevent a box 10 stacked on the central planar surface 40 from slipping off of the closed lid 24, and block drainage from flowing over them.

Figure 3:
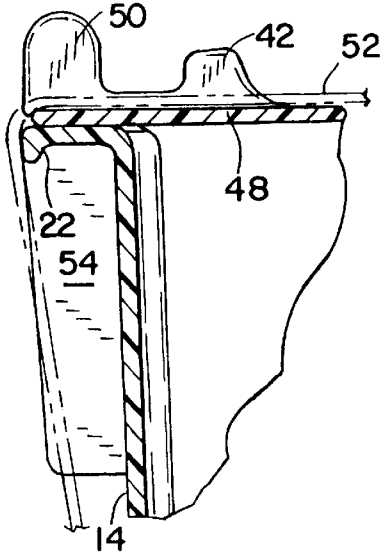
FIG. 3 is a cross sectional view of FIG. 1 along line 3—3.

As shown in FIGS. 1 and 3, cut outs 47 formed in each raised longitudinal edge 42 provide a planar surface 48 which extends from the central planar surface 40 through the raised edge 42 and hinged connections 50. The planar surface 48 provides a pathway for water or other fluid which may collect in the central planar surface 40 to flow off the box lid 24. Preferably, the cut outs 47 are sized to receive bands 52 (shown in phantom in FIGS. 1 and 3) for strapping the box 10 closed.

Looking particularly at FIG. 3, the planar surface 48 extends through the hinged connection 50 to the outer edge of the rim 22 to ensure the fluid does not enter the box interior through the hinged connection 50. Gussets 54 disposed beneath the planar surface 48 are formed as an integral part of the rim 22 and box side 14. The gussets 54 strengthen the rim 22 at the strapping location reducing the potential of rim 22 failure when the box 10 is tightly strapped using bands 52.

Preferably, the hinge connection 50 is a piano-type hinge such as disclosed in U.S. Pat. No. 5,860,527, which is commonly owned with the present invention and hereby incorporated herein by reference. The piano-type hinge 50 is substantially identical to that disclosed in U.S. Pat. No. 5,860,527, except that the planar surface 48 extends through the hinge connection defining two hinge sections 56, 58 on each side of the planar surface 48.

Referring back to FIGS. 1 and 4, the two lid pieces 26, 28 are molded plastic, e.g., polypropylene, and are substantially identical to one another. Preferably, the lid pieces 26, 28 are formed using a molding method which forms hollow channels in the plastic material, such as injection molding techniques described in U.S. Pat. Nos. 4,498,860; 4,740,150; 4,923,666; 4,923,667; and 5,770,237, which are hereby incorporated by reference. Other methods known in the art to form hollow channels may be used, such as inserting pins in the plastic material or the like, without departing from the scope of the present invention.

Each piece 26, 28 meets with the other piece in the middle of the box 10 along a substantially straight longitudinal line of closure 60 on the lid underside 38. The lid pieces 26, 28 are substantially identical and are locked together along the line of closure 60 with engagement structures of any suitable construction. For example, one possible construction is as disclosed in U.S. Pat. No. 4,432,467, which is commonly owned with the present invention and is hereby incorporated by reference.

Figure 8:
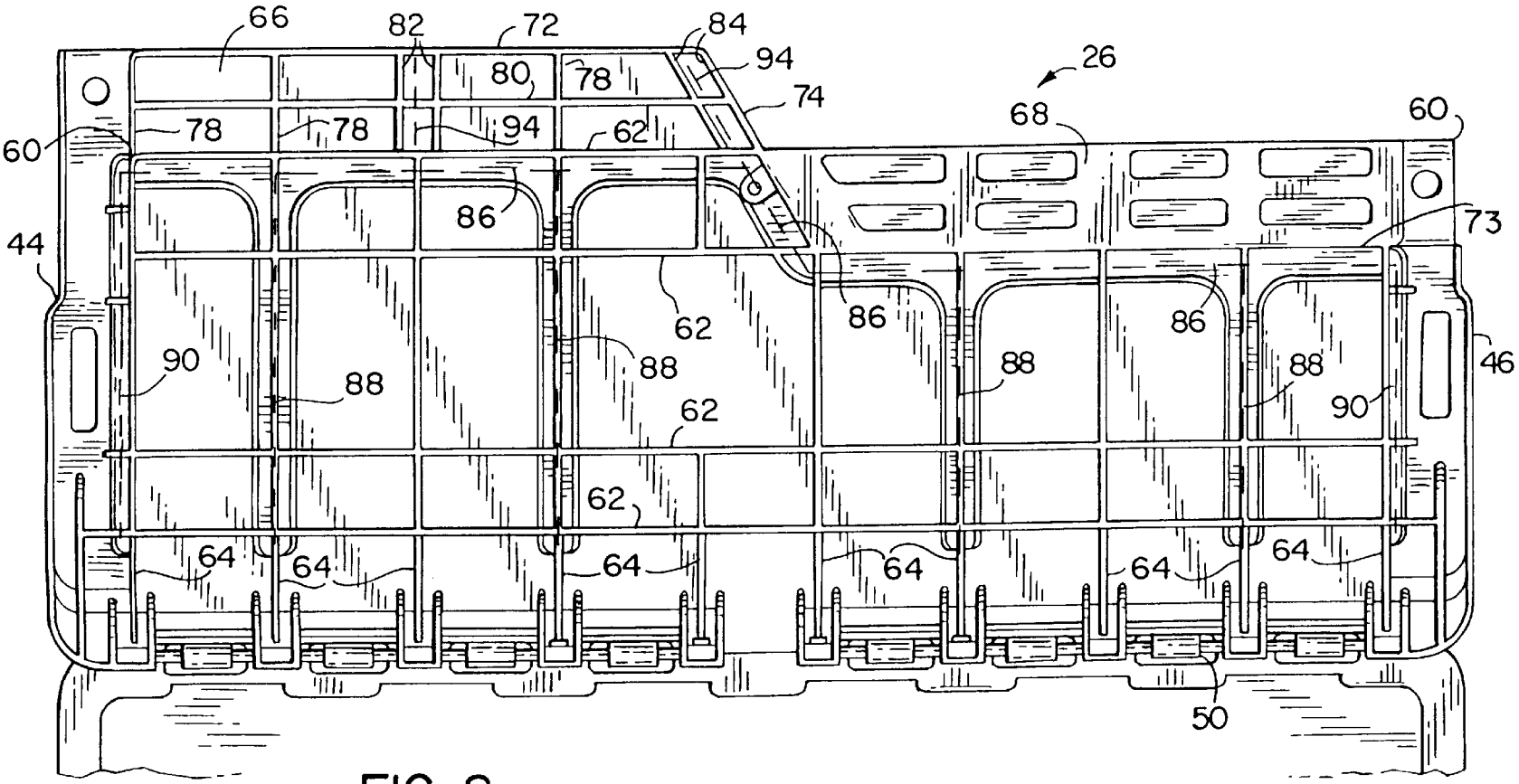
FIG. 8 is a plan view of the underside of the lid piece of FIG. 1.

Looking particularly at FIGS. 4 and 8, each lid piece 26, 28 has rib structures on its underside forming an irregular grid. The grid is defined by longitudinal ribs 62 extending from one lid end lip 44 or 46 toward the other and lateral ribs 64 extending from the hinged connection 50 toward the underside line of closure 60. The rib structures represented by the longitudinal ribs 62 and lateral ribs 64 strengthen the lid pieces 26, 28.

Referring back to FIGS. 1, 4, and 7, as is common and known from U.S. Pat. No. 4,432,467, each piece 26, 28 has an overlapping flap 66 which extends beyond the line of closure 60 to a flap edge 72 and an underlapping shelf 68 which extends from a shelf base 73 to the line of closure 60. The overlapping flap 66 and underlapping shelf 68 of each piece 26, 28 define a line of closure 70 on the lid top side 36 along the shelf base 73 and flap edge 72 which are joined by a diagonal line of closure 74.

Figure 7:
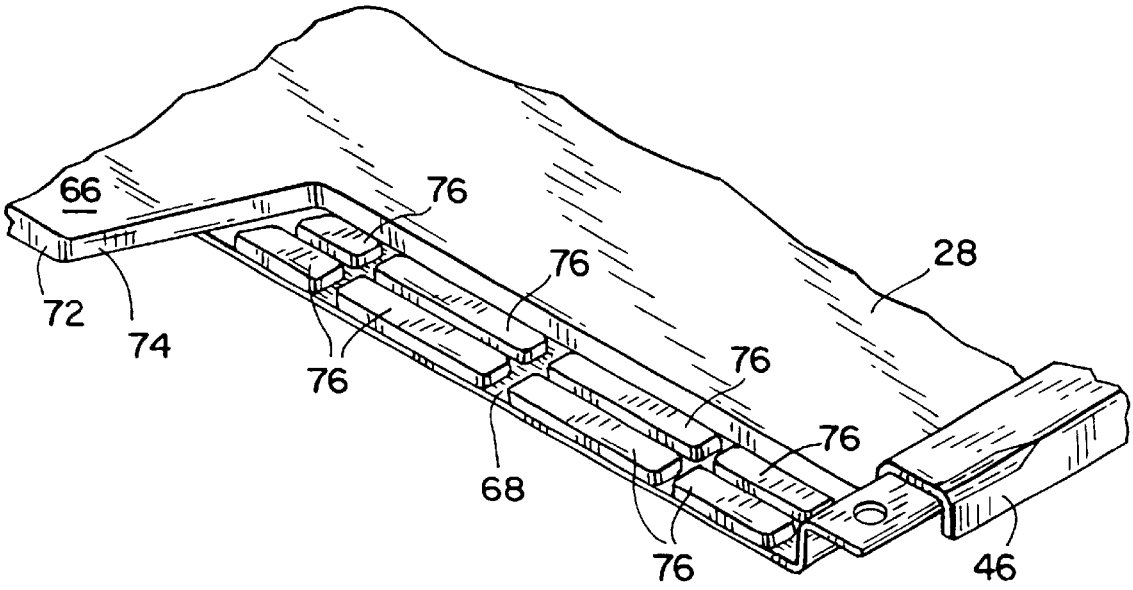
FIG. 7 is a top perspective view of the lid piece of FIG. 1.

As shown in FIGS. 7 and 8, each flap 66 has rib structures on its underside similar to those disclosed in U.S. Pat. No. 5,860,527, except since eight inverted box-like engaging structures 76, are provided on the shelf 68, the lateral ribs 78 and a longitudinal rib 80 on the flap underside are spaced and provided in number so as to receive the eight structures 76 including a centrally located double lateral rib 82 and a double rib 84 along the diagonal line of closure 74.

In addition to the lid rib structures, hollow structural channels, shown by dashed lines in FIGS. 1 and 8, in each lid piece 26, 28 increase the lid 24 structural integrity without adding additional material. A first hollow channel 86 extends from the lid piece lip 44 adjacent the flap 66 along the underside line of closure 60 toward the diagonal line of closure 74. The channel 86 then extends inward along the diagonal line of closure 74 to the shelf base 73, and then along the shelf base 73 toward the opposing lid end lip 46 adjacent the shelf 68. The first hollow channel 86 strengthens the lid 24 against bending about a lateral axis when a load is placed on the lid top side 36.

Lateral hollow structural channels 88 in each lid piece 26, 28 extend along selected lateral ribs 64 from the first hollow structural channel 86 toward the hinged connection 50 to strengthen the lid piece from bending about a longitudinal axis. At each end of the first hollow channel 86, lateral hollow channels 90 are formed in the inner wall 92 of the end lips 44, 46 to further strengthen the lid 24 and prevent the lips 44, 46 from rolling in and slipping off the end tops.

Flap hollow structural channels 94 also extend toward the flap edge 72 along the top line of closure diagonal 74, and between the centrally located double lateral ribs 82. These hollow structural channels 94 extend from, and are formed with, the first hollow structural channel 86. The flap hollow channels 94 strengthen the flap 66 which has a tendency to bend upward when a load is placed on the closed lid 24. Thus, the hollow channels 94 in the flap 66 prevent the lid 24 from opening inward under a load and allowing the load to fall into the box 10.

Closing the two substantially identical lid pieces 26, 28, having hollow channels 86, 94 along the line of closure 60, 73, provides a lid 24 with an improved load bearing capacity. The closed lid pieces 26, 28 provide parallel hollow channels on both sides of the line of closure 60 along the lateral center of the closed lid 24, and along a portion of the diagonal line of closure 74 in the lid center. Advantageously, when the lid 24 is closed, the flap hollow structural channels 94 in each lid piece 26, 28 overlap the shelf 68 of the other piece 26, 28 along the diagonal line of closure 74 in the center of the lid 24. The hollow channels 86, 94 resist lid bending at the lid line of closures 60, 74 further strengthening the structural integrity of the closed lid 24.

Preferred embodiments of the invention have been described in considerable detail. Many modifications and variations of the preferred embodiments described will be apparent to those skilled in the art which incorporate the invention. Therefore, the invention should not be limited to the embodiments described, but should be defined by the claims which follow.

I claim:

1. In a plastic tote box of the type having opposite hinged lid sections that meet along a top line of closure, each lid section having at a free edge, a shelf area and a flap area that overlaps the shelf area of the other lid section defining said top line of closure when the lid sections are closed, the improvement comprising a channel which is closed for 360° in a plane perpendicular to a longitudinal axis of the channel and formed in at least one of said lid sections to increase the strength of each lid section, said channel overlapping the other lid section when said lid is closed.

2. The improvement of claim 1, in which said channel is formed in at least one of said flaps substantially parallel to said top line of closure.

3. The improvement of claim 1, in which a bottom line of closure extends longitudinally along a substantially lateral center of said closed lid.

4. The improvement of claim 1, in which said top line of closure includes a diagonal in a central area of said closed lid.

5. The improvement of claim 1, in which said channel extends laterally from said free edge toward a hinged edge.

6. The improvement of claim 1, in which each of said lid sections has a channel formed therein extending substantially parallel to said top line of closure when said lid is closed.

7. The improvement of claim 3, in which said channel is formed in one of said lid pieces and crosses over said bottom line of closure when said lid is closed.

8. The improvement of claim 1, in which each of said lid pieces has a lip overlapping a box end top, and said lip has a channel formed therein.

9. The improvement of claim 1, in which said box has sides forming an open top covered by said lid sections, and includes a mail slot formed in at least one of said sides.

10. The improvement of claim 1, in which said lid sections form a lid having a substantially planar central area and a raised peripheral edge, and includes a cut-out formed in said peripheral edge, said cut-out providing a planar surface extending through said peripheral edge.

* * * * *